United States Patent [19]

Preist

[11] Patent Number: 4,527,091

[45] Date of Patent: Jul. 2, 1985

[54] DENSITY MODULATED ELECTRON BEAM TUBE WITH ENHANCED GAIN

[75] Inventor: Donald H. Preist, San Mateo, Calif.

[73] Assignee: Varian Associates, Inc., Palo Alto, Calif.

[21] Appl. No.: 502,431

[22] Filed: Jun. 9, 1983

[51] Int. Cl.[3] ..... H01J 25/02

[52] U.S. Cl. ..... 315/5; 313/293; 315/5.29; 315/5.37; 315/39; 332/7

[58] Field of Search ..... 315/3, 4, 5, 5.29, 5.31, 315/5.37, 5.32, 5.33, 39; 332/7, 13, 58; 313/293

[56] References Cited

U.S. PATENT DOCUMENTS

| | | | |
|---|---|---|---|
| 2,642,533 | 6/1953 | Preist | 315/39 |
| 2,945,858 | 8/1960 | Stameson | 315/39 |
| 3,116,435 | 12/1963 | Heil | 315/5.51 |
| 3,273,011 | 9/1966 | Brown | 315/39 |
| 3,453,482 | 7/1969 | Preist | 315/5.29 |
| 3,801,854 | 4/1974 | Giebeler | 315/5.29 |
| 4,210,845 | 7/1980 | Lebacqz | 315/39 |
| 4,434,387 | 2/1984 | MacMaster et al. | 315/39 |
| 4,480,210 | 10/1984 | Preist et al. | 315/5 |

*Primary Examiner*—Saxfield Chatmon

*Attorney, Agent, or Firm*—Stanley Z. Cole; Richard B. Nelson

[57] ABSTRACT

An electron beam tube is described, having a flat cathode and a flat, close-spaced grid to density modulate the beam. The beam passes through an apertured anode and then through a hollow drift tube which is the central conductor of a coaxial resonator. A gap in the drift tube extracts wave energy from the density modulated beam.

The cathode-grid region is electrically isolated from the output resonator by the length of the drift tube which is cut off as a waveguide. The circuit is thus completely grounded-grid. The input resonator, a coaxial line connected across the cathode-grid space, is loaded by the input conductance, so as to reduce the gain. The invention increases the gain by introducing regeneration between the grid-anode space and the cathode-grid space. This is done by a coupled coaxial resonator system.

19 Claims, 2 Drawing Figures

DENSITY MODULATED ELECTRON BEAM TUBE WITH ENHANCED GAIN

FIELD OF THE INVENTION

The invention pertains to electron tubes in which a linear beam of electrons is density-modulated by a control grid and the output power is generated in a resonant cavity through which the modualted beam passes.

PRIOR ART

In grid-controlled electron tubes operating at very high frequencies, resonant cavities have long been used to supply radio-frequency fields to the tube elements. The cavities are usually coaxial transmission lines terminated to support standing waves. A first, input, cavity is connected between the cathode and the control grid and a second, output, cavity between the control grid and the anode of a triode. In the case of a tetrode the output cavity is connected between the screen grid and the anode. With this "grounded grid" or "common grid" arrangement, the input conductance of the tube, that is , the ratio of the rf current leaving the cathode to the rf grid voltage, appears as a resistive loading on the input circuit. This loading decreases the power gain below that obtainable at low frequencies with the "grounded cathode" or "common cathode" circuit using lumped-circuit elements.

Cavity circuits for high-frequency tetrodes have been proposed in which the input conductance loading is reduced by adding what amounts to regenerative negative conductance. U.S. Pat. No. 2,642,533 issued June 16, 1953 to Donald H. Preist, and U.S. Pat. No. 2,706,802 issued Apr. 19, 1955 to Raymond L. Meisenheimer and Merrald B. Schrader describe coaxial circuits for controlled regeneration. The basic principle is that rf field of the input cavity system is applied between the control grid and the cathode, and also between the control grid and the screen grid in a reversed phase. The amount of regeneration was controlled by the electrical constants of the circuits, which could, if necessary, be externally adjusted.

These prior-art regeneration schemes proved to have severe problems. The isolation between input and output cavities of a tetrode amplifier is imperfect. The relatively open screen grid in the tube allows leakage of some field from the output cavity back into the control grid-cathode region, causing regeneration. Also, the amplifiers usually had an rf bypass capacitor between input and output circuits which ran at different DC potentials. The bypass always leaked some rf field. The amount and phase of this uncontrollable regeneration depended on the output cavity field. Thus, it varied with both the tuning and the loading of the output cavity. Since the output-to-input regeneration added to the controlled regeneration applied by the input circuit, the total response was unstable and hard to control. .

Another facet of the prior art deals with electron beam tubes having a resonant cavity output and a control-grid modulated linear electron beam. "An Ultra High Frequency Power Amplifier of Novel Design", by A. V. Haeff, Electronics, Feb. 1939, and "A Wideband Inductive Output Amplifier", by A. V. Haeff and L. S. Nergaard, Proceedings of the IRE, March 1940, describe such tubes. These tubes had a quite small electron beam, limited by the size of a flat control grid that could be spaced close enough to the cathode for microwave-frequency modulation. They were, therefore, limited to low power operation. Being single-stage grounded-grid devices, they also had low gain.

The klystron was soon developed. It provided almost any desired gain and very high powers. The inductive output amplifier became obsolete.

Recent work at Varian Associates, Inc. has produced a new kind of tube utilizing the inductive output principle. This tube is peculiarly adapted for UHF television video transmitters. Since these are amplitude-modulated, the average power is much less than the peak black or synchronizing pulse power. Currently widely used klystrons must have a continuous beam power high enough to generate the peak signals, so the time-average conversion efficiency is quite low. The inductive-output tube, on the other hand, is operated as a Class B amplifier in which current is drawn only as needed for the instantaneous rf peaks. The average efficiency is thus much better than a klystron's. The new tubes can generate 10's of kilowatts peak power. This is partly by virtue of flat grids of pyrolytic graphite which can be spaced very close to the cathode and can be quite large without warping or emitting electrons. When these tubes are used with conventional grounded-grid input cavities, the input circuit is loaded similar to that of a triode and the gain is low—around 15 dB.

SUMMARY OF THE INVENTION

A purpose of the invention is to provide an inductive output tube with improved gain.

A further purpose is to provide a tube with high stability.

A further purpose is to provide a tube free from oscillations.

These purposes are fulfilled by the incorporation of an input circuit in which a single input signal generates a field between the cathode and grid and simultaneously a second field between grid and anode having opposite phase to produce controlled regeneration. Stability is insured by making the drift tube between the anode aperture and the interaction gap of the output cavity long enough to reduce field leakage back into the grid-anode space to a negligible amount. Oscillations in lower-order modes of the input cavity are suppressed by selective loading of their resonances.

DESCRIPTION OF THE PREFERRED EMBODIMENTS

Figure 1:
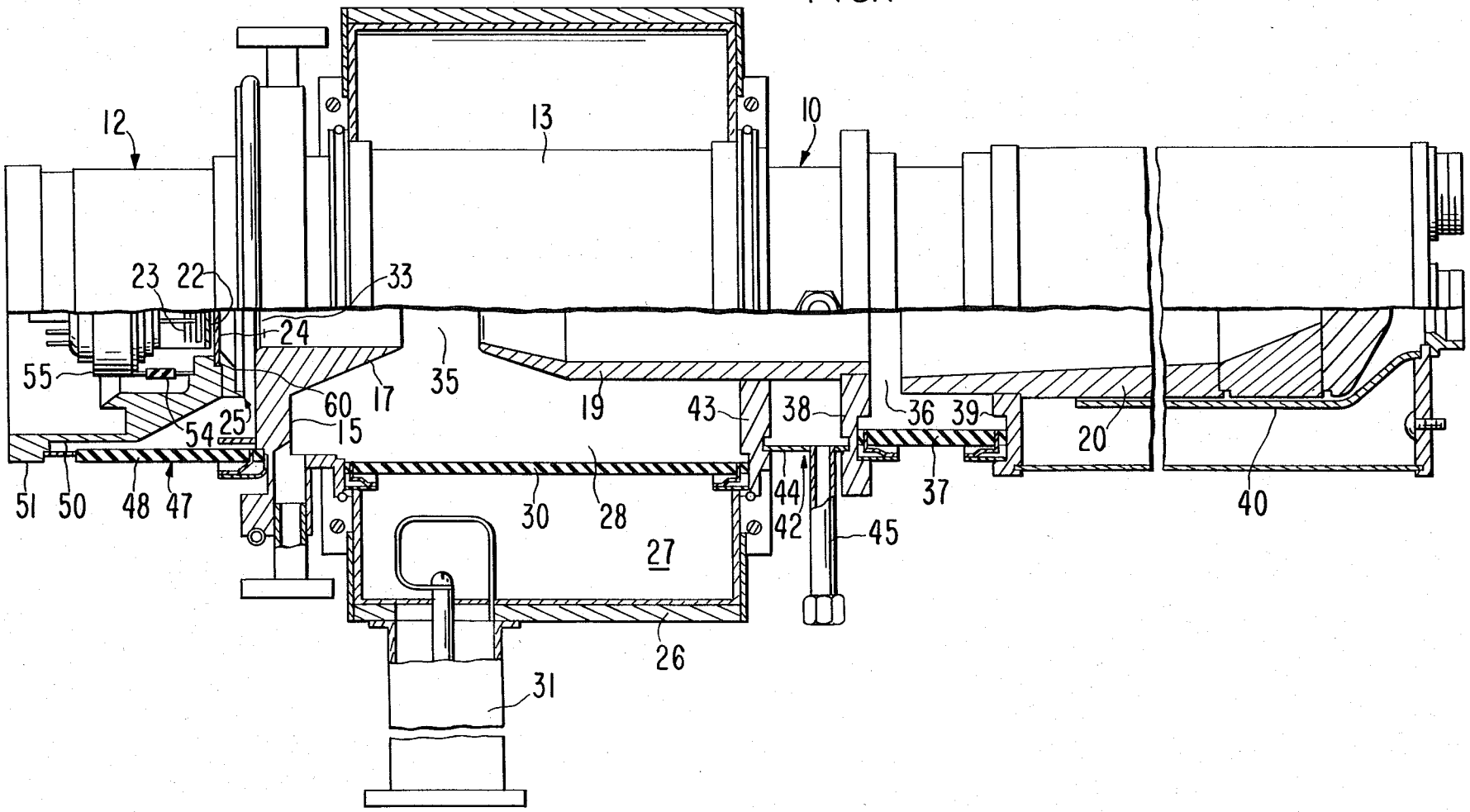
FIG. 1 is a schematic partial section of a prior-art inductive-output tube.

FIG. 1 illustrates a prior-art inductive-output tube suitable for UHF television transmitters.

FIG. 1 shows an elongated electron tube 10 defining a longitudinal axis which structurally is fairly analogous to that of a typical klystron, but which functions quite differently. Its main assemblies include a generally cylindrical electron gun and signal input assembly 12 at one end, a segmented tubular wall 13 including ceramic and copper portions defining a vaccum envelope, an axially apertured anode 15, which is extended axially to become the anode drift tube 17; a downstream "tail pipe" drift tube 19; and a collector 20 at the other end of tube 10, all axially centered and preferably of copper.

The gun assembly 12 includes a flat disc-shaped thermionic cathode 22 of the tungsten-matrix Philips type, back of which a heating coil 23 is positioned; a flat electron-beam modulating grid 24 of a form of temperature-resistant carbon, preferably pyrolitic graphite; and a grid support and retainer subassembly 25 for holding the grid closely adjacent the cathode. The cathode and grid are of relatively large diameter, to produce a correspondingly-sized cylindrical electron beam and high beam current.

A reentrant coaxial resonant rf output cavity 26 is defined generally coaxially of both drift tube portions intermediate gun 12 and collector 20 by both a tuning box 27 outside the vacuum envelope, and the interior annular space 28 defined between the drift tubes and the ceramic 30 of the tubular envelope extending over most of the axial extent of the tail pipe 19 and anode drift tube 17. Tuning box 27 is equipped with an output means including a coaxial line 31, coupled to the cavity by a simple rotatable loop. This arrangement handles output powers on the orders of tens of kilowatts at UHF frequencies. Higher powers may require integral output cavities, in which the entire resonant cavity is within the tube's vacuum envelope; a waveguide output could also be substituted. Also, additional coupled cavities may be employed for further bandwidth improvement. Although the preferred embodiment utilizes reentrant coaxial cavity 26, other inductive-circuit RF output means could be employed as well which also would function to convert electron beam density-modulation into rf energy.

An input modulating signal at frequencies of at least the order of 100 MHz and several watts in power is applied between cathode 22 and grid 24, while a steady DC potential typically of the order of between 10 up to at least 30 kilovolts is maintained between cathode 22 and anode 15, the latter preferably at ground potential. The modulating signal frequency can be lower as well as higher, even into the gigahertz range. In this manner, an electron beam of high DC energy is formed and accelerated toward the aperture 33 of anode 15 at high potential, and passes therethrough with minimal interception. Electromagnetic coils or permanent magnets positioned about the gun area outside the vacuum envelope, and about the downstream end of tail pipe 19 and the initial portion of collector 20, provide a magnetic field for the beam to aid in confining or focusing it to a constant diameter as it travels from the gun to the collector, and in assuring minimal interception through the anode. However, the magnetic field, although desirable, is not absolutely necessary, and the tube could be electrostatically focused, as with certain klystrons.

The modulating rf signal imposes on the electron beam a density modulation, or "bunching", of electrons in correspondence with the signal frequency. This density-modulated beam, after it passes through anode 15, then continues through a field-free region defined by the anode drift tube interior at constant velocity, to emerge and pass across an output gap 35 defined between anode drift tube 17 and tail pipe 19. Anode drift tube 17 and tail pipe 19 are isolated from each other by gap 35, as well as by tubular ceramic 30 which defines the vacuum envelope of the tube in this region. Gap 35 is also electrically within resonant output cavity 26. Passage across gap 35 of the bunched electron beam induces a corresponding electromagnetic-wave rf signal in the output cavity which is highly amplified compared to the input signal, since much of the energy of the energy of the electron beam is converted into microwave form. This wave energy is then extracted and directed to a load via output coaxial line 31.

After passage past gap 35, the electron beam enters tail pipe drift tube 19, which is electrically isolated not only from anode 15, but also from collector 20 by means of second gap 36 and tubular ceramic 37 and which defines a second field-free region. The ceramic 37 bridges the axial distance between copper flange 38 supporting the end of tail pipe, and copper flange 39 centrally axially supporting the upstream portion of collector 20. Thus, the beam passes through the tail pipe region with minimal interception, to finally traverse second gap 36 into the collector, where its remaining energy is dissipated. Collector 20 is cooled by a conventional fluid cooling means, including water jacket 40 enveloping the collector and through which fluid, such as water, is circulated. Similarly, anode 15 and tail pipe 19 are each provided with respective similar cooling means, best shown in FIG. 1 for the tail pipe. Means 42 includes axially-spaced parallel copper flanges 38 and 43 perpendicular to the tube axis. These, together with cylindrical envelope jacket 44 therbetween, define an annular space about the downstream end of tail pipe 19 within which liquid coolant such as water is introduced by means of inlet conduit 45, circulated, and returned through a similar outlet conduit. Although described as a unitary element in the preferred embodiment, it should be understood that collector 20 could also be provided as a plurality of separate stages.

Figure 2:
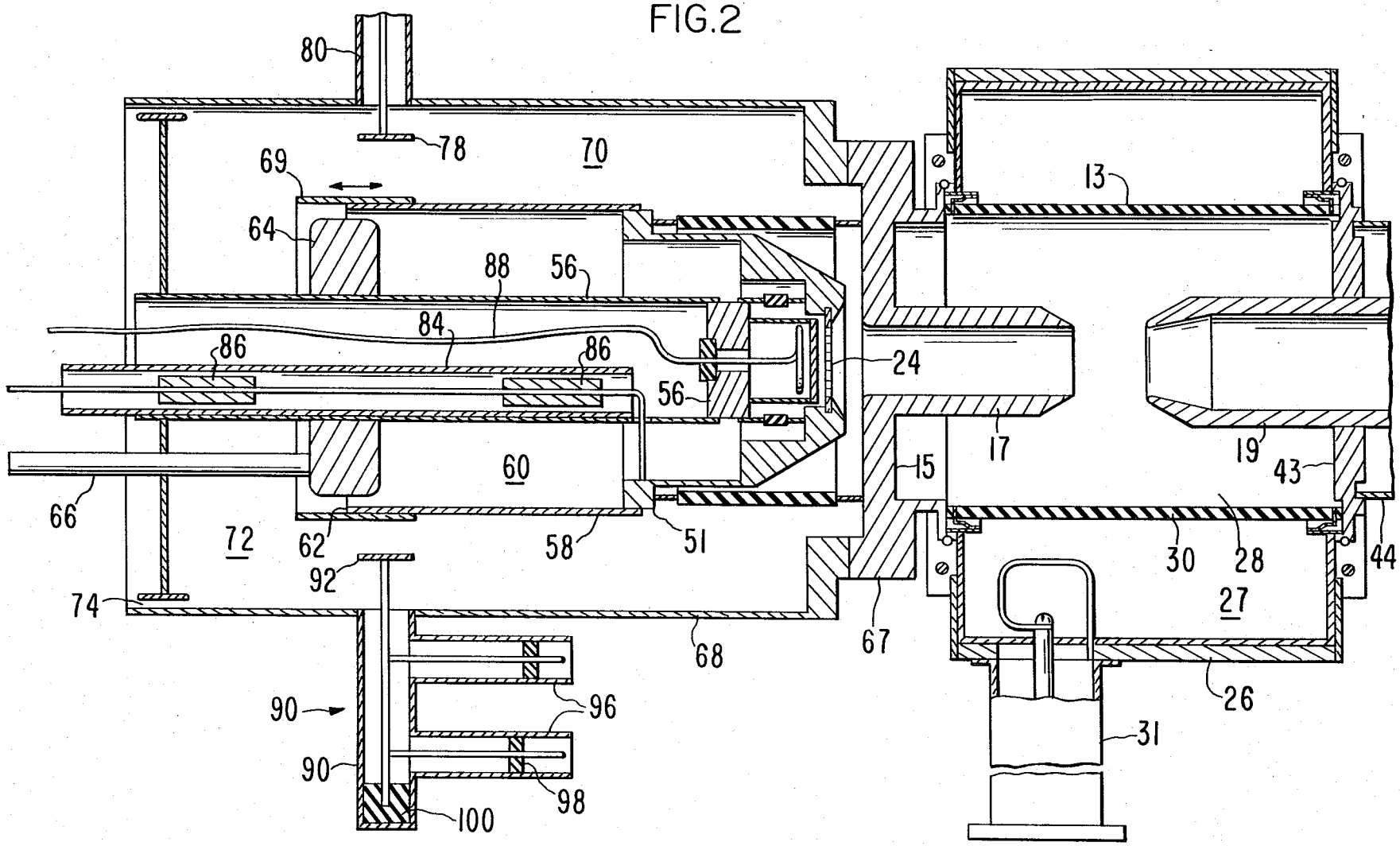
FIG. 2 is a schematic partial axial section of a tube and input circuit embodying the invention.

FIG. 2 shows an axial section of the input portion of the tube similar to that of FIG. 1 combined with an input resonant circuit according to the invention.

The cathode support 55 is joined in electrical connection with an extended hollow cylindrical tube 56. The grid support ring 51 is similarly connected to a second hollow cylindrical tube 58 outside of cathode tube 56, forming a coaxial transmission line 60. The cathode-grid space is thus connected across an otherwise open end of transmission line 60. Outer conductor 58 terminates open-circuited in free space at its other end 62. In operation, line 60 is made resonant at the operating frequency to support a standing wave with an integral number of electrical half-wavelengths. At lower frequencies this can be a single half-wavelength, but for higher frequencies it is often mechanically necessary to make line 60 one full electrical wavelength long. The resonant frequency of line 60 may be adjusted by a conductive ring 64 which slides on the center conductor 56 to vary the loading capacitance to the free end 62 of outer conductor 58, and by varying the length of tube 58 telescopically by a sliding extension 69. An insulating push-rod 66 provides external control of the tuning.

The grounded anode support ring 67 is connected to a second hollow cylinder 68 to form a second coaxial transmission line 70. At one end, line 70 terminates in the space between grid 24 and anode 15. The other end is open-circuited at the end 62 of center conductor 58 but continues as a coaxial line 72 with inner conductor being the cathode cylinder 56. Line 72 terminates in a short circuit formed by a by-pass condenser 74 on the periphery of a shorting plate 76 which slides on inner conductor 56 to tune lines 70–72 to resonance at the operating frequency. Electrically, line 72 couples cathode-grid line 60 to grid-anode line 70 so that the input signal appears in both lines. Due to the folded arrangement of the composite line, the instantaneous input voltage appears in opposite directions across the cathode-grid space and the grid-anode space. Since the circuit is resonant, the phase difference between these two voltages, as referred to the direction of electron flow, is very close to 180 degrees. Thus the peaks of current drawn when the grid is positive to the cathode cross the grid-anode space when the rf field is retarding. This generates rf wave energy in a regenerative action. The regenerative gain overcomes part of the resistive loading created in the cathod-grid space where current peaks flow when the instantaneous rf field is in the direction to accelerate electrons, thus using up rf wave energy and transforming it to electron beam kinetic energy.

The amount of regeneration is determined by the ratio of the amplitude of the rf grid-anode voltage to the rf cathod-grid voltage. The regeneration can be adjusted by varying the lengths of the various coaxial line sections and the position of the capacity loading slug 64. Increasing regeneration increases the tube's gain and decreases the bandwidth. Of course the regeneration must be below the level at which oscillation occurs.

The input drive signal is fed into coaxial line section 70 by coupling means such as a capacitive probe 78, fed through a coaxial line 80 from a signal source (not shown).

The density-modulated electron beam leaving grid 24 is accelerated through anode aperture 33. It passes through drift-tube 17 and crosses cavity gap 35 where it generates a high rf field in output cavity 26.

Input drift-tube 17 is cut off as a waveguide for all modes at the operating frequency. It is made long enough that the field leaking from output cavity 26 back into the grid-anode space is negligibly small. Thus there is essentially no regeneratin from the output circuit. If such regeneration were to occur it would make the total regenration dependent on the tuning and the loading of the output cavity, and thus very hard to adjust and control. As described above, this effect does occur in tetrode tubes to an extent that regenerative unloading of the input circuit has been accomplished, but was not proven very practical. In the tube of the present invention, output circuit feedback can be made negligible by making the length of input drift-tube 17 greater than its diameter. It is often desirable to make it greater than twice the diameter, although for tube efficiency it must be kept reasonably short.

In a cutoff waveguide such as drift tube 17, the field strength of the leakage standing wave decays exponentially with distance down the guide, (toward the grid) with an exponent inversely proportional to the diameter of the cylindrical guide.

Bias voltage for grid 24 is brought in by a wire 82 which passes inside cathode cylinder 56 as the center conductor of a coaxial ine 84. A pair of loading slugs 86 in transmission line 84 are $\frac{1}{4}$ of a space-wavelength long forming chokes to prevent leakage of rf fields out of or into the input circuit at the operating frequency and the fundamental mode frequency. Also inside cathode cylinder 56 passes the cathode heater lead 88.

As described above, it is sometimes necessary to make the resonant coaxial sections 60, 70 a full electrical wavelength at the operating frequency instead of a half wavelength. When this is done there is another mode at a lower frequency in which they resonate as half-wavelength lines. The regeneration in this mode may be enough to cause undesired oscillations. To reduce this regeneration a lossy element 90 is coupled to the resonant circuit. Element 90 is arranged to load the low-frequency half-wavelength mode while not loading the high-frequency full-wavelength mode.

This is done in one of two ways. Element 90 may be frequency-selective, such as a lossy circuit resonant at the frequency of the undesired mode. Alternatively, it may be coupled to the input circuit at a point where the field of the desired mode is low or zero and the field of the undesired mode is large. Element 90 as shown is a resonant circuit coupled to the input circuit by a capacity probe 92. A section of coaxial transmission line 94 has two stubs 96 whose electrical lengths are determined by the position of short-circuits 98 to make the element 90 resonant at the unwanted mode frequency and essentially purely reactive at the operating frequency, so that the power gain at the operating frequency is not diminished. A slug of lossy dielectric 100 absorbs wave energy at the resonant frequency.

The above-described preferred embodiment of the invention is illustrative and not limiting. Many other embodiments may be conceived by those skilled in the art. The scope of the inventions is to be limited only by the following claims and their legal equivalents.

What is claimed is:

1. A linear-beam electron tube comprising:

a cathode with an electron-emissive surface, an electron-permeable conductive grid spaced from said emissive surface and generally parallel to said emissive surface, means for applying an electromagnetic field of a desired radio frequency between said grid and said cathode for generating a current-modulated beam of electrons emerging said grid, an anode spaced from said grid opposite said cathode, said anode comprising an aperture for passage of said beam, said means for applying said radio-frequency field comprising resonant means for applying from a single source a first field between said cathode and said grid and a second field between said grid and said anode, said first and second fields being approximately of opposite phases with respect to the direction of flow of said beam, thus providing for regenerative unloading of said source, a hollow conductive drift tube for transmission of said beam from said anode aperture away from said cathode, a gap in said drift tube for applying the electromagnetic field of a surrounding cavity, resonant near said desired frequency, across said gap, the length of said drift tube between said aperture and the beginning of said gap being greater than the diameter of said drift tube, whereby the space between said grid and said anode is substantially shielded from fields of said cavity, and means for collecting said beam downstream of said gap.

2. The tube of claim 1 wherein said means for applying radio-frequency field comprises coaxial line means wherein one end of said coaxial line means is connected across a first space between said cathode and said grid and the other end of said coaxial line means is connected across a second space between said grid and said anode.

3. The tube of claim 2 wherein the electrical length of said coaxial line means, as loaded by said spaces and other discontinuities, is approximately an integral number of half-wavelengths at said desired frequency, whereby said coaxial line means is resonant in an operating mode near said desired frequency.

4. The tube of claim 3 wherein said integral number is one.

5. The tube of claim 3 wherein said integral number is two, whereby said coaxial line means is also resonant in a fundamental mode at a frequency below said desired frequency.

6. The tube of claim 5 further comprising lossy means for selectively loading said fundamental mode resonance to suppress oscillation at said fundamental frequency.

7. The tube of claim 6 wherein said loading is selective for the frequency of said fundamental mode resonance.

8. The tube of claim 6 wherein said loading is spatially selective to appear at a point where the field of said fundamental mode is not zero and where the field of said operating mode is approximately zero.

9. The tube of claim 7 wherein said loading is a lossy circuit resonant near said fundamental resonance and coupled to said coaxial line means.

10. The tube of claim 1 wherein said means for applying radio-frequency field comprises:

first coaxial line means, a frist end of which is connected between said cathode and said grid, the second end of said first coaxial line being electrically open-circuit, and second coaxial line means, a first end of which is connected between said grid and said anode, the second end of said second coaxial line being electrically open-circuit, said second ends of said coaxial line means being mutually coupled.

11. The tube of claim 10 wherein said first line and said second line have electrical lengths of integral multiples of a half wavelength.

12. The tube of claim 10 wherein said first coaxial line is coaxial with said second coaxial line.

13. The tube of claim 10 wherein the outer conductor of said first coaxial line is integral with the inner conductor of said second coaxial line.

14. The tube of claim 13 wherein the inner conductor of said frist coaxial line and the outer conductor of said second coaxial line extend beyond said second ends of said first and second coaxial lines to form a third coaxial line, whereby said first and second lines are mutually coupled.

15. The tube of claim 14 wherein said third coaxial line is resonant at approximately said desired frequency.

16. The tube of claim 14 further comprising a capacity loading slug near said second end of said first coaxial line.

17. The tube of claim 2 further comprising coaxial bias line means within the inner conductor of said coaxial line, the outer conductor of said bias line being connected to said cathode and the inner conductor of said bias line being connected to said grid.

18. The tube of claim 17 further comprising choke means in said bias line resonant near said desired fequency.

19. The tube of claim 1 wherein the length of said drift tube between said aperture and the beginning of said gap is greater than twice the diameter of said dirft tube.

* * * * *